US007501374B2

(12) United States Patent
Galiasso

(10) Patent No.: US 7,501,374 B2
(45) Date of Patent: Mar. 10, 2009

(54) OXYGEN-CONTAINING DIESEL FUEL, PROCESS AND CATALYST FOR PRODUCING SAME

(75) Inventor: Roberto Galiasso, Miranda (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 11/834,762

(22) Filed: Aug. 7, 2007

(65) Prior Publication Data

US 2008/0045407 A1 Feb. 21, 2008

Related U.S. Application Data

(62) Division of application No. 10/961,457, filed on Oct. 7, 2004.

(51) Int. Cl.
*B01J 31/00* (2006.01)
*B01J 27/24* (2006.01)

(52) U.S. Cl. ..... 502/200; 502/150; 502/152; 502/153; 502/162; 502/163; 502/165; 502/167

(58) Field of Classification Search ..... 502/200, 502/207, 150, 152, 153, 162, 163, 165, 167
See application file for complete search history.

(56) References Cited

U.S. PATENT DOCUMENTS

| | | | | |
|---|---|---|---|---|
| 3,130,244 | A * | 4/1964 | Nixon | 585/527 |
| 3,663,660 | A * | 5/1972 | Delbouille et al. | 526/124.2 |
| 3,909,450 | A * | 9/1975 | O'Hara | 502/200 |
| 4,667,053 | A * | 5/1987 | Lin | 560/204 |
| 5,789,333 | A * | 8/1998 | Angelici et al. | 502/113 |
| 6,028,025 | A * | 2/2000 | Ying et al. | 502/171 |
| 7,208,437 | B2 * | 4/2007 | Renock et al. | 502/117 |
| 2007/0149391 | A1 * | 6/2007 | Yeung et al. | 502/232 |
| 2008/0045407 | A1 * | 2/2008 | Galiasso | 502/200 |

FOREIGN PATENT DOCUMENTS

JP 01-228556 * 9/1989

* cited by examiner

*Primary Examiner*—Patricia L Hailey
(74) *Attorney, Agent, or Firm*—Bachman & LaPointe, P.C.

(57) ABSTRACT

A process for upgrading a diesel fuel, includes the steps of providing a diesel fuel feedstock; hydrogenating the feedstock at a pressure of less than about 600 psig so as to provide a hydrogenated product wherein a portion of the feedstock is converted to alkyl-naphthene-aromatic compounds; and selectively oxidizing the hydrogenated product in the presence of a catalyst so as to convert the alkyl-naphthene-aromatic compounds to alkyl ketones. A catalyst and oxygen-containing Diesel fuel are also provided.

2 Claims, 4 Drawing Sheets

OXYGEN-CONTAINING DIESEL FUEL, PROCESS AND CATALYST FOR PRODUCING SAME

CROSS REFERENCE TO RELATED APPLICATIONS

This application is a divisional application of U.S. application Ser. No. 10/961,457 filed Oct. 7, 2004.

BACKGROUND OF THE INVENTION

The invention relates to improving the properties of Diesel fuels and, more particularly, to a process and catalyst for incorporating oxygen into the fuel.

There is a need for Diesel fuel having lower exhaust emissions. Diesel fuel containing oxygen can meet some desired specification, but only by improving the cetane number and reducing particulate emissions. A problem remains in connection with NOx emissions. Various ways are known for introducing oxygen into Diesel fuel, but all have their drawbacks, including expensive and severe processing, poor properties of the product, poor distribution of the oxygen through the product and the like.

Despite many attempts at different ways of introducing oxygen-containing molecules into Diesel fuel, the need clearly remains for a process for introducing such oxygen containing molecules into the fuel which is effective at reducing the NOx emissions of the fuel as well as improving other properties.

It is therefore the primary object of the present invention to provide a process for producing such a fuel.

It is a further object of the invention to provide a Diesel fuel containing oxygen distributed over the entire distillation point range of the fuel.

It is another object of the invention to provide a catalyst which is effective in production of such a fuel.

Other objects and advantages of the present invention will appear herein below.

SUMMARY OF THE INVENTION

In accordance with the present invention, the foregoing objects and advantages have been readily attained.

According to the invention, a process is provided for preparing a Diesel fuel, which process comprises the steps of providing a diesel fuel feedstock; hydrogenating the feedstock at a pressure of less than about 600 psig so as to provide a hydrogenated product wherein a portion of the feedstock is converted to alkyl-naphthene-aromatic compounds; and selectively oxidizing the hydrogenated product in the presence of a catalyst so as to convert the alkyl-naphthene-aromatic compounds to alkyl ketones.

Further according to the invention, a catalyst is provided for use in selective oxidation of certain fractions of a treated Diesel fuel, which comprises between about 1% and about 5% wt of an element selected from the group consisting of oxides of Co, Ni, Fe, Cr, Cu and mixtures thereof; a Pd oxide promoter in an amount between about 300 and about 10,000 wt ppm, and a nitrogen compound deposited on a support and being present in an amount between about 1% and about 4% wt.

In further accordance with the invention, a Diesel fuel is provided which comprises an oxygen containing diesel fuel which contains at least about 0.1% wt of oxygen in ketone-type molecules bound to alkyl-naphthene compounds, wherein the oxygen is substantially distributed over a distillation range of the fuel.

BRIEF DESCRIPTION OF THE DRAWINGS

A detailed description of preferred embodiments of the present invention follows, with reference to the attached drawings, wherein.

DETAILED DESCRIPTION

Figure 1:
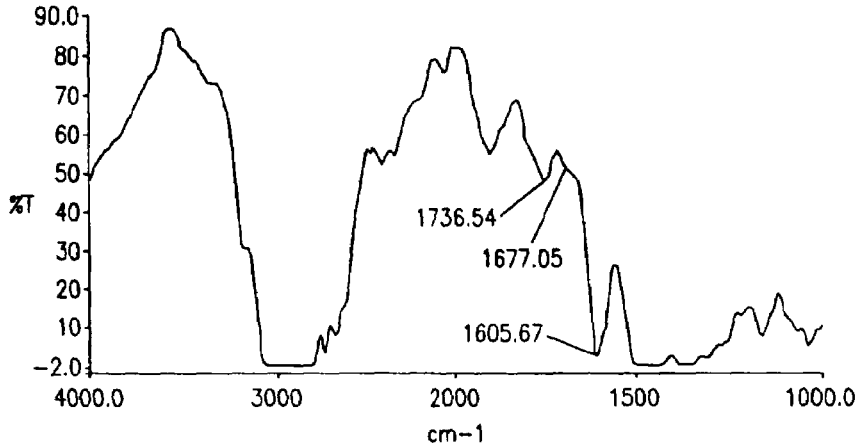
FIG. 1 illustrates FTIR spectra for a hydrogenated product in accordance with the present invention.

This invention relates to of an emission storage and handling improved Diesel fuel containing a substantially homogeneous distribution of oxygen through the entire range of boiling points of the fuel. This oxygen containing fuel is produced by transformation of the initial molecular structure existing in conventional Diesel feedstock by treatment with a series of processes or steps which make a particular highly selective chemical modifications towards ketone compounds.

This homogeneous distribution of oxygen in oxygen-containing molecules provides a Diesel fuel with better ignition delay, lower particulate and NOx production, near zero water-insoluble compound and content totally stable molecules during storage and handling. The sequence of process of steps consists of a low-pressure catalytic hydrotreating followed by selective catalytic oxidation, followed by selective adsorption. The molecular modification starts with selective hydrogenation of a conventional Diesel fuel in order to increase the content of oxidizable molecules to be selectively catalytically oxidized through the entire boiling range of the fuel, followed by the selective adsorption.

The chemical modification starts with a low severity hydrogenation stage where a maximum amount of alkyl-naphthene-aromatic compound are formed. Then a selective oxidation is carried out using a particular catalyst and particular operating conditions that maximize alkyl ketone formation. The particular catalyst is prepared using one or combinations of the following metals: Cu, Ni, Fe, Cr and Co, in oxide or salt form (Me1) and a metal promoter such as Palladium in oxide or salt form (Me2), and a nitrogen compound in the surface of the catalyst. These components are added to a support in a way that provides a particular intercalation referred to as NMe1Me2, and the catalyst is used in conditions where minimum thermal reactions occur. The oxidation process conditions are selective to achieve the best contact between phases, specifically the Diesel, air and catalyst.

Feedstock

Different refinery streams containing high sulfur, high aromatic contact, and low cetane number can advantageously be used as feedstock for the process of the present invention.

Table 1 shows the properties and composition of a suitable feedstock: light catalytic cracking gas oil (LCCO), light coker gas oil (LKGO), light virgin gas oil (LVGO) and kerosene (Ker). The amount of di-ring-aromatics varies between 10 and 70% by weight. The higher the di-ring-aromatic content, the worse the quality of the component but better feed for this invention. Cracked and coker light gas oil are also suitable feedstocks. Table 2 shows a typical feed properties blend of LCCO: 20-30%, LVGO: 30-40%, LKGO: 20-40%, Kerosene: 5-15%.

TABLE 1

| Properties | LCCO | LKGO | LVGO | Kerosene |
|---|---|---|---|---|
| Sulfur wt % | 0.235 | 1.340 | 0.947 | 0.310 |
| Nitrogen wt ppm | 130 | 434 | 213 | 10 |
| Mono aromatics | 15.4 | 28.1 | 10.1 | 124 |
| Di-ring-aromatics | 10.3 | 4.6 | 4.6 | 4.8 |
| Tri-ring-aromatics | 2.4 | 0.0 | 1.0 | 0.0 |
| Naphthenes | 31.3 | 29.4 | 33 | 32 |
| Paraffin | 27 | 28 | 18 | 25 |
| Cetane number | 48 | 33 | 51 | 40 |

TABLE 2

| | |
|---|---|
| Density at 15.6° C. (ASTM D-4052) g/mL | 0.8788-0.7888 |
| Sulfur wt ppm (ASTM D-2622) | 5,000-20,000 |
| Nitrogen wt ppm (ASTM D-4629) | 300-1,000 |
| Aromatics wt % | 25-65 |
| Di-ring-aromatics wt % | 10-32 |
| Cetane number | 28-44 |
| T90° C. | 330-375 |

Table 3 shows aromatics distribution by range of distillation (molecular weight) and by mono-alkyl, -dialkyl, and -trialkyl-di-ring aromatics. It can be seen in Table 3 that there is a particular alkyl aromatics distribution along the distillation curve, which depends on the component (cracked or virgin) used in the Diesel blending. Mono- and di-alkyl-di-ring-aromatics or naphthenic type-compounds mainly compose them. These compounds are particularly responsible for the low cetane number and high emissions of the Diesel, but are well suited for the present invention when they are hydrogenated and oxidated in the proper position as described below. Other compounds could also contribute in the process of the invention, such as alkyl-tri-ring-aromatics, but they are present in minor amounts as shown in Table 1. Also evident is the chemical and sterical difference between a Diesel component and a tetralin or similar compound, which will affect the rate of reaction and the selectivity of a porous catalytic material.

Tables 1 and 2 describe particularly well suited feedstocks for the present invention. Of these properties, it is particularly desirable that the feed have an aromatic content of at least about 20% wt and a cetane number of less than about 44. The sulfur content can be relatively high, since the initial step of the process of the present invention is an excellent sulfur removing step as well.

The stages or sequential steps of the invention are described below. In particular, preferred catalyst formulation, the chemistry and the operating conditions required, as well as, product properties, are discussed below.

TABLE 3

| | NMR analysis (semi-quantitative) | | | |
|---|---|---|---|---|
| Compound | 200-250° C. | 250-300° C. | 300-350° C. | 350° C.+ |
| Mono alkyl wt % | 28-37 | 27-35 | 22-38 | 28-37 |
| Di alkyl wt % | 30-41 | 30-35 | 28-34 | 29-36 |
| Tri-alkyl wt % | 10-12 | 10-22 | 20 | 20 |

Hydrogenation Step

The Diesel feedstock to be treated, for example as described in Table 2, and in particular the alkyl-substituted naphthenes or aromatics compounds (Table 3) present in the fuel, have a low cetane number due to their short alkyls group (n- or iso-paraffins). These compounds are produced by the fluid catalytic cracking process (FCC) and show the shortest alkyl hydrocarbons chain branched to the aromatics due to cracking processes that occurred in a narrow catalyst pore structure. This favors the break of the long alkyl-paraffin. Nevertheless, those low cetane number compounds can be transformed into a useful compound by selective hydrogenation and ring opening of the aromatic structure, which converts the di-ring-aromatics (and others aromatics) into iso- and n-paraffins. Such conversion can conventionally be carried out in high pressure units (not always available at the refinery). High-pressure processes are very expensive in hydrogen consumption and capital expenses, and the ring opening chemistry is not totally achieved by commercial catalysts.

The present invention goes in a different direction because it requires a simple one-ring-aromatic hydrogenation to maximize the alkyl-naphthenes-aromatic compound fraction. This fraction is the intermediate product in the total hydrogenation. These intermediate compounds still have a low cetane number and produce a high emission when used in a Diesel engine, but they are useful for further chemical transformation. To produce the preferred chemical modification using the available Diesel components, first the blend is treated in a low-pressure hydrotreating unit (currently available from 400-600 pig) to remove sulfur to the required level (from around 10,000 ppm to the 15-500 ppm range). At the same time alkyl-poly-ring aromatic compounds are only hydrogenated into alkyl naphthene mono- or di-ring aromatics.

A conventional NiMo or $CoMo/Al_2O_3$ catalyst is used, and intermediate production is preferably tracked. The operating pressure at this stage is between about 400 and 600 psig (15-50 bars) space velocity between about 0.3 and 2 $h^{-1}$ and temperature between about 300° C. and 410° C. The process is preferably carried out at a hydrogen to hydrocarbon ratio of between about 80 and about 400 Nl/l (normal liters of hydrogen to hydrocarbon). Any standard reactor is useful for this step. By using a low space velocity. A low sulfur Diesel component can be achieved even at low pressure, and in addition, hydrogenation of poly aromatics and production of alkyl-naphthene-aromatics is obtained. In these conditions, hydrogenation does not proceed further to obtain totally saturated alkyl-naphthenes compounds. The operating conditions selected are suited for the desired partial hydrogenation and deep sulfur removal, without cetane improvement. Table 4 shows two cases of hydrotreating, one with a low sulfur production (500 ppm of sulfur), and the other with ultra-low sulfur Diesel production (15 ppm sulfur). Both are non-limiting examples of the application of products of the hydrogenation stage of this invention.

TABLE 4

| Operating conditions: Temperature 330-360° C., Pressure = 500 psig, LHSV: 0.7-1.5 $h^{-1}$, $NiMo/Al_2O_3$ from Feed I | | |
|---|---|---|
| Properties of the Products | LSD 500 ppm | ULSD 15 ppm |
| Density at 15.6° C. (ASTM D-4052) g/mL | 0.8691 | 0.8875 |
| Sulfur wt ppm (ASTM D-2622) | 150-500 | 15-5 |
| Monoaromatics | 30-40 | 35-43 |
| Diaromatics | 5-10 | 18-7 |
| Triaromatics | 1-5 | 8-4 |
| Paraffin | 20-30 | 21-26 |
| Naphthenes | 25-35 | 18-20 |
| T90° C. | 330-360 | 358-362 |
| Cetane | 37-42 | 40-46 |

It can be seen that, using a non acidic commercial hydrotreating catalyst (i.e. K575) and at these operating conditions, an improvement of less than 2 or 3 cetane numbers is produced, even when the sulfur is dramatically reduced from 10,000 to 500 or 15 wt ppm. Density and T90 suffer a minor change and the transformation produces a still out-of-spec-Diesel product due to low cetane number. More severe operation conditions would produce a cracking of the existing alkyl-group. No matter how deep the residence time or temperature, the cetane number will still be too low for Diesel marketing. However, this product is useful for the present invention since it contains the proper intermediate compounds for further chemical modification. Table 5 shows the alkyl compound distributions through the distillation curve for product between 500 ppm and 15 wt ppm of sulfur. The variation is in the range of the NMR semi-quantitative analysis (the complement being non-identified branched compounds).

TABLE 5

| Alkyl-di-ring-naphthene-aromatic compounds (products between 500 to 15 ppm of sulfur). wt % of total aromatics (~50%) (NMR analysis) | | | |
|---|---|---|---|
| Compound in HDT Diesel | 200-250° C. | 250-300° C. | 300-360° C. |
| Mono alkyl naphthene-aromatics | 22-28 | 28-32 | 32-34 |
| Di alkyl-naphthene-aromatics | 42-45 | 40-42 | 36-38 |
| Tri alkyl-naphthene-aromatics | 20-22 | 18-20 | 19-21 |

It can be seen that hydrogenation in moderate pressure and temperature do not modified the alkyl distribution originally present, nor the distillation range. If more acidic catalyst, such as a mild hydrocracking or a hydrocracking catalyst is used, the alkyl-branch naphthene-aromatics are cracked and the benefits of the hydrogenation are lost.

The present invention is particularly well-suited for those intermediate products (partially hydrogenated) where a high proportion of di- and trialkyl-naphthene-aromatics can be generated. The typical FTIR spectra (characteristic) is shown in FIG. 1 and does not indicate any signal in the range of 1650-1720 cm−1 (where the carbonyl group of ketone compounds is located).

Selective Oxidation Step

Selective oxidation of the hydrotreated product is done using a catalyst prepared with a particular intercalation (NMe1Me2m) based on the following metals: Cu, Ni, Fe, Cr and Co (Me1), and Pd as a promoter (Me2) in oxide or salt form. The particular selective catalyst has a nitrogen compound in the surface as well. This nitrogen compound is linked to both Metal 1 and Metal 2 in the catalyst, and preferred Nitrogen-containing compounds include diamine, porphyrin, quinoline and combinations thereof.

The hydrotreated product is partially oxidized using air at low pressure and low temperature continuous equipment. The process operates at 5-40, preferably 10-20 bars of total pressure, and 60 to 140° C., preferably between about 60 and about 100° C. of liquid phase in the reactor. Hydrotreated Diesel can be fed upwardly or downwardly, depending on the type of temperature control desired. The catalyst can be installed in a fixed bed or an ebulliated or floating bed where the catalyst is suspended, for example in a slurry form, by the dynamic fluid pressure in the reactor. Space velocity is preferably between about 0.1 and about 2.0 $h^{-1}$ and air flow is preferably between about 1 and about 1,000 (NPT) 1/h (liters at normal pressure and temperature per hour).

Figure 2:
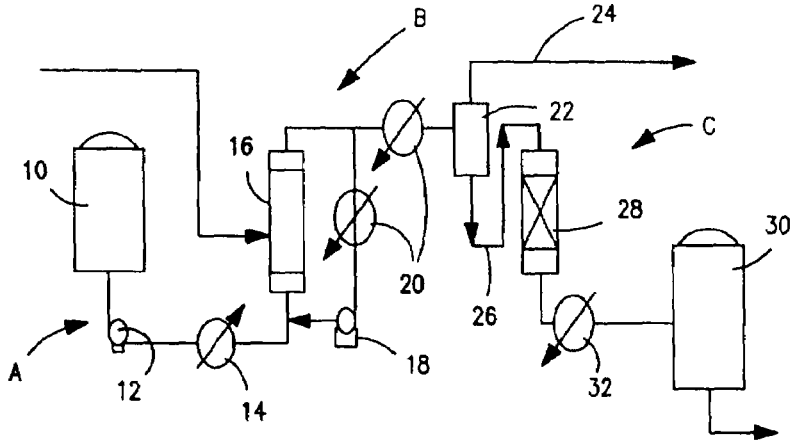
FIG. 2 schematically illustrates an oxidation-adsorption process in accordance with the present invention.

One preferred type of process scheme is shown in FIG. 2, presented as a non-limiting example of the present invention. The plant could be divided in three zones as described herein.

The first Zone A includes a hydrotreated Diesel storage tank 10 which is optional since feedstock can be fed directly from the HDT plant, a Diesel pump 12 and a pre-heater 14 to carry the feed to reaction condition (2-10 bars of pressure and 80-180° C. of temperature). The second Zone B, includes reaction Zone 16 which can be formed by a one or two stage reactor, for example one or two fixed bed or ebulliated bed reactors using one or two catalysts.

The beds can be operated up-flowing in a co-current mode of operation (air and Diesel) or in a counter-current mode, wherein Diesel flows downward while air flows upward in the reactor. An external or internal recycle 18 is provided to control reaction temperature and the level of oxidation.

Air provides the oxygen for the oxidation in liquid phase but any other source of molecular oxygen can be employed, such as oxygen diluted streams, while the system performs at operating conditions (ratio oxygen/hydrocarbon, temperature and pressure) which are well out of the explosion region. The oxidation reactor preferably has an on line oxygen sensor which has a high alarm set to 4-5% before enforcing a safety procedure. Oxygen is preferably introduced in the reactor using a gas or gas liquid distributor which is designed to provide a small bubble size (high inter-phase mass transfer rates), according with known designing of gas-liquid reactors. The reactors operate in fixed bed adiabatic type mode (catalyst is confined by lower and upper grids) and will use recycle of the liquid phase to provide a high linear velocity in the reactor to assure a negligible control of the chemical reaction by liquid-catalyst external mass transfer. the reactor also provides a means to control the temperature (using external cooler). The recycle can vary from 1 to 20 times the inlet flow rate. Reactors operating in ebulliated bed conditions also require external recycle to keep the catalyst fluidized by liquid motion. A special control device is provided to avoid temperature excursions. The reactor effluent is cooled at step 20, preferably to about 50° C. and then the gas phase is separated at step 22. Gas phase 24 is sent to the flare, and the liquid phase to the adsorption stage 28 or Zone C. Catalyst composition and particle size diameter are the critical point to achieve the maximum selectivity and conversion to produce a stable Diesel 30.

Figure 3:
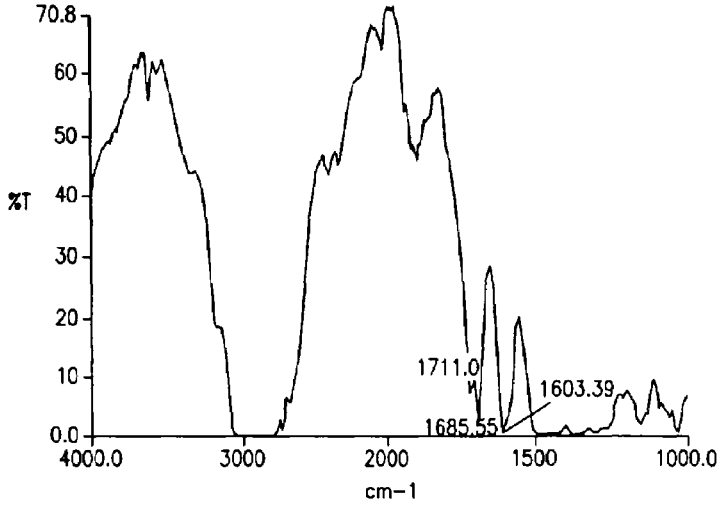
FIG. 3 illustrates the FTIR spectra for hydrotreated and oxidized Diesel fuel.

Table 6 shows a typical range of hydrogenated-oxidized product properties, obtained for one catalyst of the present invention and for the 500 wt ppm hydrogenated Diesel feed described in Table 5. Table 6 shows the ability of the invention to keep nearly constant the distillation range and density but to improve the oxygen content and cetane number of the product. The FTIR spectra (FIG. 3) show the characteristic signal of ketone type molecules (1685-1720 $cm^{-1}$). Other minor oxygen signals are detected at 3510 $cm^{-1}$ and 3590 $cm^{-1}$ due to the v(OH) of hydroperoxide and/or alcohol groups.

It can be observed that an important oxygen incorporation can be achieved (~0.5-2% of $O_2$) and still preserve product stability. The Cetane number is increased between 10 to 20 numbers and a small change in density and distillation range occurs. Most of the oxygen is in the form of ketones as desired. The production of hydroperoxides, alcohols, and other types of oxygenate compounds is negligible. The selective oxidation step also advantageously provides for a ratio by weight of non-ketone oxygen to ketone-bound oxygen of between about 0.01 and about 0.1.

TABLE 6

(CuPd/N,N'-biquinoline/Amberlite IRC50) T: 60-80° C., LHSV: 0.6-1.5 $h^{-1}$, Pt: 200 psig, $FO_2$: 200-300 l/h

| | |
|---|---|
| Density | 0.8791-0.990 |
| T90° C. | 365-372 |
| Oxygen content wt % | 0.5-2.0 |
| Ketones wt % | 4.0-20.0 |
| Peroxides wt % | <<0.01 |
| Alcohols wt % | <0.01 |
| ASTM 2274 MG/L (Oxidation Stability) | <<0.01 |
| Cetane number | 50-55 |

Catalysts

The catalyst is preferably a heterogeneous complex of Co, Cu, Fe, Ni, and Pd or organometallic precursors thereof, and combinations of them, supported in a solid having carboxylic groups or amines type groups at the surface. The final catalyst contains a particular N/Metal ratio at the surface and is capable to interact with alkyl-naphthene aromatic molecules. The nitrogen-containing compound is advantageously linked to both metals, that is, the two (or more) metals selected from the above group. Preferably the metals include Pd as promoter and at least one of the other metals, and this structure us referred to above as NMe1Me2. Table 7 shows XPS information that presents surface typical range of metal dispersion. The typical metal content is between 1 to 15% as metal or metal oxide by weight of total catalyst, preferably between about 1% and about 5% wt. Promoter such as palladium is preferably present in an amount between about 300 and about 10,000 wt ppm, and nitrogen containing compound is preferably present in an amount between about 1 and about 4% wt. The molar ratio between metals can vary between 0.01 and 2. The nitrogen/metal molar ratio can vary between 0.1 and 2 at the surface.

Conventional oxidation of pure tetralin involves addition of different types of amine into the feed (around 1% by weight). Particular types of amine in solution are said to be better than others. This is totally impractical in the present invention, however, because 0.1 to 1% by volume of amine contaminates the Diesel fraction and is hard to remove, and will produce color instability and some water solubility. In addition, the amines have to be added each time that a new Diesel is processed, which is costly.

The stable catalytic nitrogen-metal structure of the present invention works in continuous operation without adding substantial amounts of nitrogen with the feed. Table 7 shows the particular N/Me ratio associated with a stable catalytic structure, which can be exposed to large amounts of Diesel per amount of catalyst without losing catalytic properties.

TABLE 7

XPS Example of metal and nitrogen dispersions Catalyst surface composition

| Catalyst (typical) | Signal eV | N/Me |
|---|---|---|
| Co/N on resin | 781.2 | 0.56 |
| Fe/N on resin | 710.0 | 0.31 |
| Cu/N on resin | 934.8 | 0.70 |
| Ni/N on resin | 856.2 | 0.45 |
| Cr/N on resin | 577.5 | 0.38 |

This particular catalytic structure, which was previously not well understood, assures a maximum selectivity to transform poly-alkyl-di- and tri-ring naphthene aromatics into poly-alkyl-di-/tri naphthene-ketone-aromatics through a particular reaction pathway as described herein. The resulting product includes 1-2 wt % of oxygen in the Diesel, where many nitrogen and sulfur compounds were present, and maintains the color stability, prevents gum formation and reduces emissions. During catalytic Diesel oxidation, non-measurable peroxide formation was detected. Without catalysts, at the reaction conditions selected, no oxidation occurred.

Selectivity is defined as the ratio of ketones by the total amount of alkyl-naphthene-aromatics. The catalyst is able to convert any alkyl-naphthenes-aromatics that are not impeded by alpha position of the naphthenic ring. The chemistry is similar to the tetralin to 1-tetralone reaction, but the selectivity is different due to the alkyl group, which contributes by an electronic factor and by a sterical factor to the reactivity of the compound. Table 8 shows the oxygen compound distribution in the product along the distillation cuts for NCuPd/IRCR50 for different residence time, as an example. For this particular feedstock, oxygen compounds are more concentrated in the lighter part of the Diesel cut even when naphthene-aromatics are well distributed, indicating an important selectivity of the catalyst toward some types of alkyl compounds.

TABLE 8

Alkyl-di-ring-naphthene-aromatics ketone distribution compounds

| Compound in HDT Diesel | 180-250° C. | 250-300° C. | 300-360° C. |
|---|---|---|---|
| Total oxygen content wt % | 1.3-2.4 | 0.6-1.3 | 0.1-0.7 |

This Diesel shows more concentration of indanone and tetralone in the lighter fraction. This provides a particular cetane number distribution along the cut that can not be emulated by adding oxygen compounds or adding a commercial cetane improver, or by oxidation with $H_2O_2$.

Figure 4A:
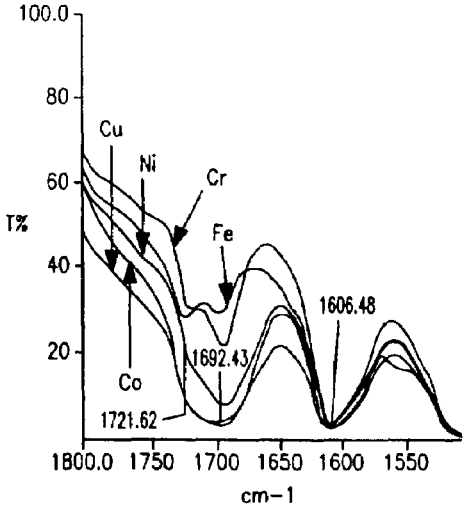
FIGS. 4 A and B illustrate FTIR spectra for oxidized Diesel after treatment with a particular catalyst, and with respect to 1-tetralona, respectively.
Figure 4B:
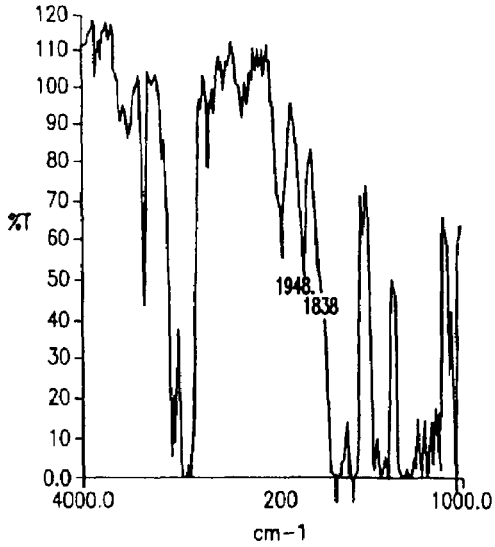

Typical FTIR spectra of the product are presented in FIGS. 4 A and B for different catalyst preparations. It can be seen that two (2) signals centered between 1685-1720 $cm^{-1}$ appear. These correspond to alkyl-ketone-naphthene-aromatic compounds which are not present in the feed. As a reference, the FTIR of the pure tetralone compound is also shown.

Adsorption Step

The adsorption step or stage of the invention provides removal of color forming precursors and water-soluble compounds such as phenols, acid and peroxides formed in minor quantities and nitrogen compounds. The adsorbent used is preferably alumina, modified alumina, clay, montmorillonite, bentonite, spent FCC catalyst, basic resin, activated carbon and mixtures thereof, or any other solid with a selective adsorption to retain OH groups (alcohol, acid and peroxides). The range of operating conditions is: temperature between room temperature and about 80° C., more preferably between about 30 and about 50° C., pressure between about 1 and about 40 bars, preferably between about 1 and about 10 bars, and LHSV between about 0.1 and about 10 hours$^{-1}$, more preferably between about 0.1 and about 6 h$^{-1}$.

In the system of FIG. 2, one zone includes an adsorption tower 32. Liquid from the bottom of the cold separator 22 is sent to swing-down-flow adsorption section 28, where different adsorbent can be used. The adsorption tower works continuously in a fixed bed down flow mode and the adsorbent can be regenerated or downloaded and replaced when it becomes exhaust. Other ways of adsorption can be implemented without departing from the invention. The final product is sent to storage tank 30 and tested to check properties as shown in Table 9, which also shows engine behavior. Less than 0.01% of oxygen remains in the filter and the Diesel is clear and bright, stable, no more toxic than standard Diesel, and transportable.

TABLE 9

| Product | Oxygen wt % | Color | Color Stability | Water solubility** | Guns (ASTM2274) |
|---|---|---|---|---|---|
| Feed | 0 | ASTM L1-2 | ASTM L (2.5-5) | Less than wt 0.2% | 0.6-1.5 |
| Product 1 (500 ppmS) | 0.8-2.5 | ASTM L1-2 | ASTM L (1.5-2) | Less than wt 0.01% | 0.01-0.1 |
| Product 2 (50 ppmS) | 0.8-2.5 | ASTM L1-2 | ASTM L (1.5-2) | Less than wt 0.01% | 0.01-0.1 |

*Color stability at storage.
**Water solubility g/g Diesel

No FTIR modification is observed after adsorption. Final oxidated Diesel products were tested in Diesel Engines (Isuzu) at lab testing facilities where the exhaust gasses were analyzed using a micro-tunnel technique. The detail of the procedure is indicated in Example 1. NOx, particulate, CO, and HC emissions and the range expected were measured and reported in Table 10.

TABLE 10

| | Exhaust gas toxic composition (1200 rpm, no EGR, medium charge) | | | |
|---|---|---|---|---|
| Properties | NOx | PM | HC | CO |
| Feed III | 6.98 | 0.61 | 1.36 | 1.35 |
| Oxidated Diesel | 5.5 | 0.49 | 1.12 | 1.13 |

It can be seen that going from the original feed (Feed III) to the oxidated Diesel, emissions can be improved by the present invention. Also, the intermediate product is far from the emission benefits of the complete chemical modification of the present invention.

The following examples show operation of the present invention. A particular test also shows the impact of adding an oxygen compound (DMMO) with the same amount of oxygen as contained in the oxidated Diesel. Other tests were performed to show the impact of adding tetralone as in the prior art. Finally, a test was included to show performance of the invention with amine in the catalyst in comparison with amine in the Diesel as in the prior art (U.S. Pat. No. 4,473,711).

EXAMPLE 1

The feeds are a tetralin diluted in decaline (Feed I), and a Diesel blend (Feed II). The latter is composed of 30% of LKGO+30% LCCO+30% LVGO+10% Kerosene that contains 0.1 wt % sulfur, 300 ppm nitrogen and 55% aromatics. It has cetane of 38, density of 0.8991 and a color of 1.5 ASTM.

EXAMPLE 2

Diesel with the composition indicated above is hydrogenated in a conventional fixed bed pilot plant. A 100 cc sample of a commercial Ni—Mo type catalyst (TK 754) was placed in the reactor. The catalyst is presulfided at 300° C. and 400 psig of pressure using a sulfur containing Diesel feed. Desulfurization is carried out at 360° C., 500 psig, a space velocity of 0.7 h$^{-1}$ and hydrogen/hydrocarbons ratio of 100/1. The product quality is reported in Table 11 under Feed II. In the same table the properties are provided for Feed I as well. Table 12 shows alkyl distribution along the distillation curve for the hydrogenated Diesel or intermediate product (Feed III).

TABLE 11

| Properties of the Products | Tetralin/decaline I | Hydrotreated II |
|---|---|---|
| Density | | 0.8834 |
| Sulfur wt ppm | 0 | 435 |
| Mono aromatics | 30 | 28 |
| Diaromatics | 0 | 15 |
| Tri-aromatics | 0 | 3 |
| Paraffins | 0 | 20 |
| Naphthenes | 70 | 34 |
| IBP | 180 | 180 |
| T90° C. | 198 | 362 |
| Cetane number (*Calculated) | *~32 | 40 |

TABLE 12

| Compound | 200-250° C. | 250-300° C. | 300-362° C. |
|---|---|---|---|
| Mono-alkyl wt % | 25 | 29 | 33 |
| Di-alkyl wt % | 43 | 41 | 7 |
| Tri-alkyl wt % | 21 | 18 | 20 |

EXAMPLE 3

A catalyst according to the invention is prepared in this example. This example shows preparation of a CuPd catalyst, but the procedure can of course be used to prepare catalyst using other suitable metals as described above, for example FePd, NiPd, CoPd, CrPd and the like. The procedure is as follows: In a stainless steel recycle reactor, equipped with a temperature control and a sampling device, was placed 100-1000 gr. of support (Amberlite IRC50 or Reillex™425 polymer). A solution of 40-400 mole of copper (as $Cu(NO_3)_2$ hydrated salt, or organometallic-nitrogen-complex), in 1 liter of water was recycled through the support till no more copper (or other metal) adsorption occurred. Then the catalyst is dried by passing 300 NPT 1/h of air at 80° C. for three hours. A 0.2-2 mole solution of palladium (as palladium tetramine salt) in 1 liter of water was recycled through the support till no more palladium adsorption occurred. Then 2-20 mmol of biquinoline diluted in methanol (or other proper organic solvent) was recycled till nitrogen-adsorption equilibrium is achieved. In the case of a Reillex™425 polymer or a water-soluble complex metal-nitrogen, it is not necessary to pass any amine because the aromatic amine is in the polymer matrix, or in the coordination sphere of the transition metal. The catalyst is then dried using air at 300 NPT 1/h for 5 hours at 80° C. The catalyst is removed and sent for properties analysis and characterization such as Elemental chemical analysis, x-ray photoelectron spectroscopy (XPS), Nuclear magnetic resonance (NMR), and Infrared spectroscopy (FTIR). The final catalyst properties are indicated in Table 13.

Catalyst according with the previous art (U.S. Pat. No. 4,473,711) is prepared according to with the following procedure: Fifty grams of Amberlite IRC50 was exchanged with Chromium acetate aqueous solution by soaking the resin in the solution for 24 hours washing repeatedly with water, then with acetone and finally drying.

TABLE 13

Catalyst properties

| Composition | NCuPd | NCoPd | NNiPd | NFePd | NCrPd | Prev Art Cr |
|---|---|---|---|---|---|---|
| Metal oxide (main) wt % | 2.5-14 | 0.7-6.3 | 0.5-4.7 | 0.3-3.5 | 0.5-3.8 | 3.92 |
| Metal oxide (promoter) ppm | 500 | 500 | 500 | 500 | 500 | 0 |
| Support IRC50 (g.) | 100-1000 | 100-1000 | 100-1000 | 100-1000 | 100-1000 | 100-1000 |
| N/Me (XPS) | 0.38-0.44 | 0.30-0.43 | 0.28-4.00 | 0.2-1.20 | 0.23-0.71 | 0.40-3.20 |

EXAMPLE 4

Oxygen incorporation in the absence of catalyst, using Feed I and II without catalyst, was done to check thermal reaction effects. A 50 ml sample of feed was placed in the reactor. The reactor is heated at 80° C., pressurized to 15 bar of air under stirring speed of 600 rpm with airflow of 200 cc/min. The temperature, airflow, stirring speed, and air pressure were maintained constant during the reaction time (1 to 3 hours). After that time, the reactor was cooled, depressurized, and the liquid was sent to analytical characterization. Results are set forth in Table 14.

TABLE 14

| Sample | Oxygen wt % | Color |
|---|---|---|
| Feed I | 0.30 | Yellow-red |
| Feed II | 0.15 | Yellow |

Figure 5:
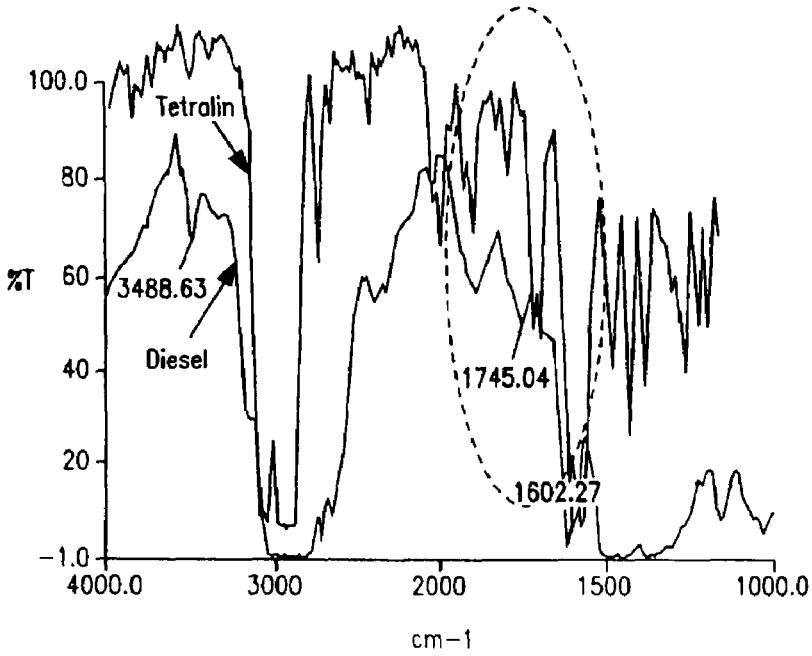
FIG. 5 illustrates FTIR spectra for Feed I and Feed II of the examples.

As can be seen in Table 14, a minor oxidation occurs in Feed II (Diesel) which contains less than 0.2% wt of oxygen. Also there is no well defined band related to some C═O formation (FIG. 5). Initial color in feed I was yellow but quickly degraded to brown during storage, indicating the presence of unstable reaction products. Tetralin (Feed I—FIG. 5) shows an FTIR spectra with bands associated to tetralone-tetralol and peroxide and it contains 0.30% wt of oxygen (Table 14). The final color was between yellow and red but quickly degraded to brown during storage. Clearly it can be concluded that there is no interest in thermal reactions that are limited at the present conditions without catalyst.

EXAMPLE 5

Figure 6:
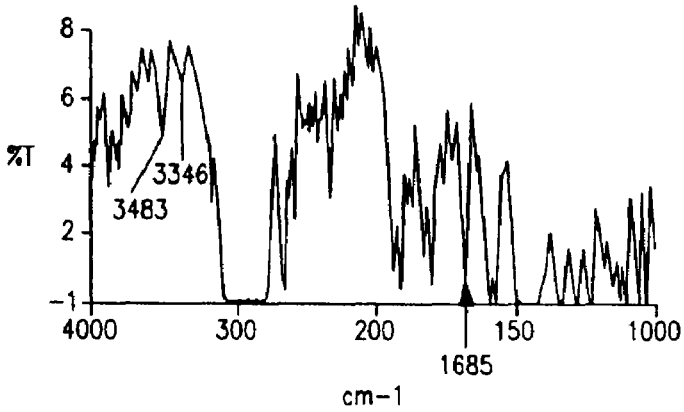
FIG. 6 illustrates FTIR spectra for oxidized Feed I of the examples.
Figure 7:
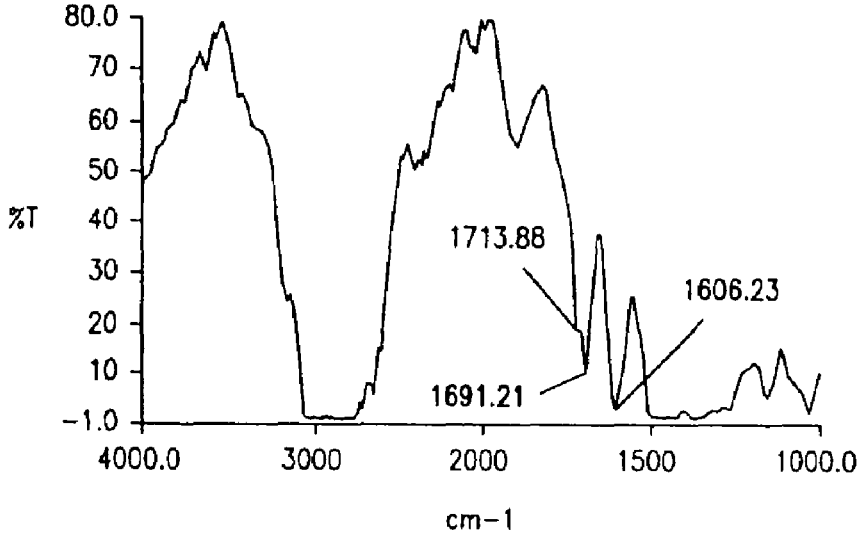
FIG. 7 illustrates FTIR spectra for oxidized Feed II of the examples.

Feeds with the composition presented in Table 11 were oxidized using a stirred tank semi-discontinuous "Parr" reactor (semi-batch). The reactor is equipped with an internal stirring device a temperature control, and sample valves. A 50 ml sample of feed was placed in the reactor together and 5 gr. of catalyst. Then, the reactor is heated at 80° C., pressurized to 15 bar of air under stirring speed of 600 rpm with airflow of 200 cc/min. The temperature, airflow, stirring speed, and air pressure were maintained constant during the reaction time (1 to 3 hours). After that time, the reactor is cooled and depressurized, and the liquid was sent to analytical characterization. As is shown in Table 15, depending on the type of matrix fuel used, different amount of oxygen is achieved. The table presents the results obtained with the catalyst of the present invention and the prior art for Feeds I and II. FTIR spectra for oxidated Feed I (tetralin) is shown in FIG. 6, for oxidated Feed II in FIG. 7.

TABLE 15

| Sample | Oxygen wt % | Color |
|---|---|---|
| Feed I | 2.3 | Yellow-red |
| Feed II | 1.8 | Yellow |

Table 16 shows that all of the catalyst formulations are effective to oxidize tetralin. When Diesel is treated, not only tetralin type compounds are present, but also many types of naphthenic aromatic compound poly ring-aromatics are present.

TABLE 16

Total oxygen content in oxidized feed I and II

| | Cat | | | | | |
|---|---|---|---|---|---|---|
| Feed | NCoPd | NCuPd | NFePd | NNiPd | NCrPd | Cr |
| Feed I | 1.7 | 2.1 | 1.8 | 1.3 | 2.2 | 1.9 |
| Feed II | 1.6 | 1.7 | 1.4 | 1.2 | 1.8 | 1.7 |

EXAMPLE 6

The selectivity of the catalyst of the present invention in modifying the type of compound that is produced by oxidation is demonstrated in this Example. The results of three products, using different catalysts, are shown in Table 17.

TABLE 17

| Product properties | NCuPd | NCrPd | NCr |
|---|---|---|---|
| Density kg/l | 0.8786 | 0.8792 | 0.8812 |
| Viscosity ssu 120° C. | 4 | 4.3 | 5.0 |
| T90 | 364 | 365 | 368 |
| Cetane number | 57 | 58 | 54 |
| Water solubility gr/l | <0.1 | <0.1 | 0.5% |
| Stability ASTM 2274 mg/l | 0.1 | 0.1 | 0.3 |
| Ketones % wt. | 15 | 12 | 6 |
| Peroxides % wt. | <0.1 | <0.1 | 0.34 |

Table 17 shows the difference in the final product oxidated Diesel prepared according to the invention. These products are more stable and have a better cetane number than those produced using the oxidation catalyst of the prior art. The chemical constitution of oxidated Diesel is different due to the oxidation selectivity. Having established this important fact, fuel performance can also be considered.

EXAMPLE 8

To understand the enhanced properties of the oxidated Diesel, emission tests using a Diesel engine were performed. Four Diesel fuels were studied:

1) oxidated Diesel prepared according to the invention (a NCuPd product described above was chosen), having the properties described in Table 13;
2) The hydrotreated Diesel (Feed II used as feedstock of the oxidation stage (see properties in Table 13) but adding a cetane improver to reach the same cetane number as oxidated Diesel according to the invention.
3) The hydrotreated Diesel (Feed I) used as feedstock of the oxidation stage but adding an oxygenate additive Dimethyl Ethyl Ether (DMMNO) to reach the same amount of oxygen as the oxidated Diesel according to the invention;
4) Hydrotreated Diesel (Feed II), oxidized according with the prior art catalyst (see properties in Table 13).

The engine characteristics are presented in Table 18. A Euro II type engine with no EGR and no intercooling facilities was used, which is a direct injection engine, 200 HP light duty operating at 2000 rpm.

TABLE 18

| Isuzu Diesel engine characteristic | |
|---|---|
| Type | Isuzu 6BD1T |
| Displacement | 6 cylinders-5.78 lts |
| Compression ratio | 17.5:1 |
| Maximum Torque | 445.5 Nw-m at 1800 rpm |
| Maximum Power | 114.1 kW at 2500 rpm |

With this engine, and using a microtunnel dilution technique NOx, PM, CO and HC were determined at stationary conditions. The characteristics of the 4 feed stocks and emission results are shown in Tables 19 and 20, respectively.

TABLE 19

| Feedstock properties | | | | |
|---|---|---|---|---|
| Properties | 1 | 2 | 3 | 4 |
| Cetane Number D613 | 38 | 47.0 | 47.1 | 46.3 |
| Oxygen % wt | 0 | 0 | 1.5% | 1.5% |
| Cetane improver EHN % vol | 0 | 0.8 | 0.8 | 0 |

1: Feed II
2: Feed II + Cetane improver
3: Feed II + Cetane improver + DMMNO
4: Oxidated Diesel Table 20 shows the improvement made in NOx and particulate emission that occurred by oxidation using the present invention. Comparing the results from the second and third rows in Table 19 it is seen that this reduction in emission is not due to the increase in cetane number. Higher emission was observed by adding a cetane improver to have the same cetane number as oxidated Diesel. In other words, the ignition delay improvement is not the unique reason for the emission reduction, as it was previously believed. In the same way comparing the fourth row with the second row, it is seen that emission reduction is not due to oxygen content. The oxidated Diesel has the same total oxygen but a different type and distribution of oxygen molecules. In other words, the oxygen content in the flame core is not the unique reason to reduce the emission as was previously believed. The fuel improvement is more associated with the mechanism of toxic formation (NOx & PM). Comparing the fifth row with the second row of Table 20, it can be concluded that the improvement in emission of the oxidated Diesel is due to the particular way that the fuel is oxidized, and this cannot be emulated using prior art teachings.

The oxidation catalyst of the present invention has proper selectivity to convert alkyl naphthene-aromatic molecules to the proper molecules, even without establishing how they perform these emission improvements.

TABLE 20

| Diesel engine emissions | | | | |
|---|---|---|---|---|
| | NOx | PM | CO | HC |
| Feed II | 6.975 | 0.607 | 1.348 | 1.359 |
| Feed II oxidized (e Diesel) | 5.499 | 0.485 | 1.189 | 1.176 |
| Feed II + cetane improver | 5.581 | 0.560 | 1.293 | 1.309 |
| Feed II + DMMNO | 5.750 | 0.503 | 1.261 | 1.284 |

EXAMPLE 9

This example illustrates that the ratio of oxygenated alkyl-di-ring-naphthene-aromatic ketone compounds to the related non-oxygenated compounds has to be greater than zero and distributed along the Diesel cut in oxidated Diesel. Three Diesel fuels were studied: Fuel 1) oxidated Diesel prepared according to the invention (using a NCuPd catalyst described above, and having the properties described in Table 13); Fuel 2) hydrotreated diesel (Feed II) used as feedstock of the oxidation stage but adding one alkyl-di-ring-naphthene-aromatic oxygenated compound tetralone to reach the same amount of oxygen as the oxidated Diesel; Fuel 3) the hydrotreated diesel (Feed II). The ratio of oxygenated alkyl-di-ring-naphthene-aromatic ketone compounds to the related non-oxygenated compounds in Fuel 2 is greater than zero in C10 section and zero in the rest of the oxygenated compounds. The engine characteristics are the same as Example 8.

Table 21 shows the improvement made in NOx and particulate emission that occurred by oxidation using the present invention (Fuel 1) and distribution of oxygenated compounds along the diesel cut.

TABLE 21

| Diesel engine emissions | | | | |
|---|---|---|---|---|
| | NO*x* | PM | CO | HC |
| Feed II – Fuel 3 | 6.975 | 0.607 | 1.348 | 1.359 |
| Feed II oxidized (oxidated Diesel) – Fuel 1 | 5.499 | 0.485 | 1.189 | 1.176 |
| Feed II + Tetralone (1.5% wt Oxygen) – Fuel 2 | 6.429 | 0.512 | 1.235 | 1.202 |

It should be appreciated that the present invention provides a process, a Diesel fuel product, and a catalyst, which are well suited to reduction of emissions as desired. The catalyst and process advantageously provide for selective incorporation of oxygen into specific fractions of the feedstock, and substantially evenly distribute the oxygen over the different boiling ranges of the feed.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A catalyst for selective oxidation of alkyl-naphthene-aromatic compounds, the catalyst comprising between about 1% and about 5% wt of an element Me1 selected from the group consisting of oxides of Co, Ni, Fe, Cr, Cu and mixtures thereof; an oxide promoter Me2 in an amount between about 300 and about 10,000 wt ppm, and a nitrogen compound deposited on a support and being present in an amount between about 1% and about 4% wt, wherein the nitrogen compound is linked to both Me1 and Me2 to form a structure NMe1Me2.

2. The catalyst of claim 1 wherein the support is selected from the group consisting of carboxylic polymer, nitrogen-containing polymer, and nitrogen compound grafted on a silica support, and combinations thereof.

* * * * *